US005895874A

United States Patent [19]

Liao

[11] Patent Number: 5,895,874

[45] Date of Patent: Apr. 20, 1999

[54] WIDE ANGLE TOM-TOM HOLDER

[75] Inventor: Tsun-Chi Liao, Taichung, Taiwan

[73] Assignee: HWA Shin Musical Instrument Co. Ltd., Taichung, Taiwan

[21] Appl. No.: 08/891,735

[22] Filed: Jul. 14, 1997

[51] Int. Cl.[6] ..... G10D 13/02

[52] U.S. Cl. ..... 84/421; 84/327

[58] Field of Search ..... 84/421, 327; 248/278.1

[56] References Cited

U.S. PATENT DOCUMENTS 4,453,446 6/1984 Hoshino ..... 84/421

5,804,747 9/1998 Chen ..... 84/327

*Primary Examiner*—William M. Shoop, Jr.

*Assistant Examiner*—Shih-yung Hsieh

*Attorney, Agent, or Firm*—Bacon & Thomas, PLLC

[57] ABSTRACT

A wide angle tom-tom holder including a mounting base having a bottom coupling hole coupled to a top end of an upright support, two ball socket assemblies respectively fastened to the mounting base, two balls respectively turned in the ball socket assemblies, and two L-shaped supporting rods respectively connected to the balls and adapted for holding a respective drum, wherein the mounting base has an extension block at one side, two upward coupling chambers respectively defined within the extension block, two projecting blocks respectively disposed in the upward coupling chambers, two mounting through hole respectively made through the center of the projecting blocks; each ball socket assembly has an upper shell and a hollow bottom shell fixedly fastened together and defining a ball socket therebetween for holding one ball, the upper shell having a vertical through hole connected to one mounting through hole of the mounting base by a screw bolt and a nut, and a tubular flange downwardly raised from a bottom side thereof around the vertical through hole and mounted around one projecting block of the mounting base.

2 Claims, 10 Drawing Sheets

Fig.1 PPIOR ART

WIDE ANGLE TOM-TOM HOLDER

BACKGROUND OF THE INVENTION

The present invention relates to tom-tom holders, and more particularly to a wide angle tom-tom holder which can be conveniently adjusted to change the angular positions of the drums carried thereon.

FIG. 1 shows a tom-tom holder for holding drums on an upright support of a drum stand according to the prior art. This structure of tom-tom holder comprises a mounting base supported on an upright support of a drum stand and defining two circular recesses, two cup plates fixedly fastened to the mounting base over the circular recesses and defining with the circular recesses a respective ball socket, two balls respectively turned in the ball sockets between the circular recesses of the mounting base and the cup plates, and two angle rods respectively extended from the balls and adapted for holding a respective drum. This structure of tom-tom holder is functional. However, because the two ball sockets which are defined between the circular recesses of the mounting base and the cup plates are immovable, the pitch between the two angle rods cannot be widely adjusted.

SUMMARY OF THE INVENTION

It is the main object of the present invention to provide a wide angle tom-tom holder which can be conveniently installed and adjusted to change the supported drums to the desired angles. According to the preferred embodiment of the present invention, the wide angle tom-tom holder including a mounting base having a bottom coupling hole coupled to a top end of an upright support, two ball socket assemblies respectively fastened to the mounting base, two balls respectively turned in the ball socket assemblies, and two L-shaped supporting rods respectively connected to the balls and adapted for holding a respective drum, wherein the mounting base has an extension block at one side, two upward coupling chambers respectively defined within the extension block, two projecting blocks respectively disposed in the upward coupling chambers, two mounting through hole respectively made through the center of the projecting blocks; each ball socket assembly has an upper shell and a hollow bottom shell fixedly fastened together and defining a ball socket therebetween for holding one ball, the upper shell having a vertical through hole connected to one mounting through hole of the mounting base by a screw bolt and a nut, and a tubular flange downwardly raised from a bottom side thereof around the vertical through hole and mounted around one projecting block of the mounting base; two spring elements are respectively mounted around the screw bolts and retained between the projecting blocks and the upper shells of the ball socket assemblies.

DETAILED DESCRIPTION OF THE PREFERRED EMBODIMENTS

Figure 8A:
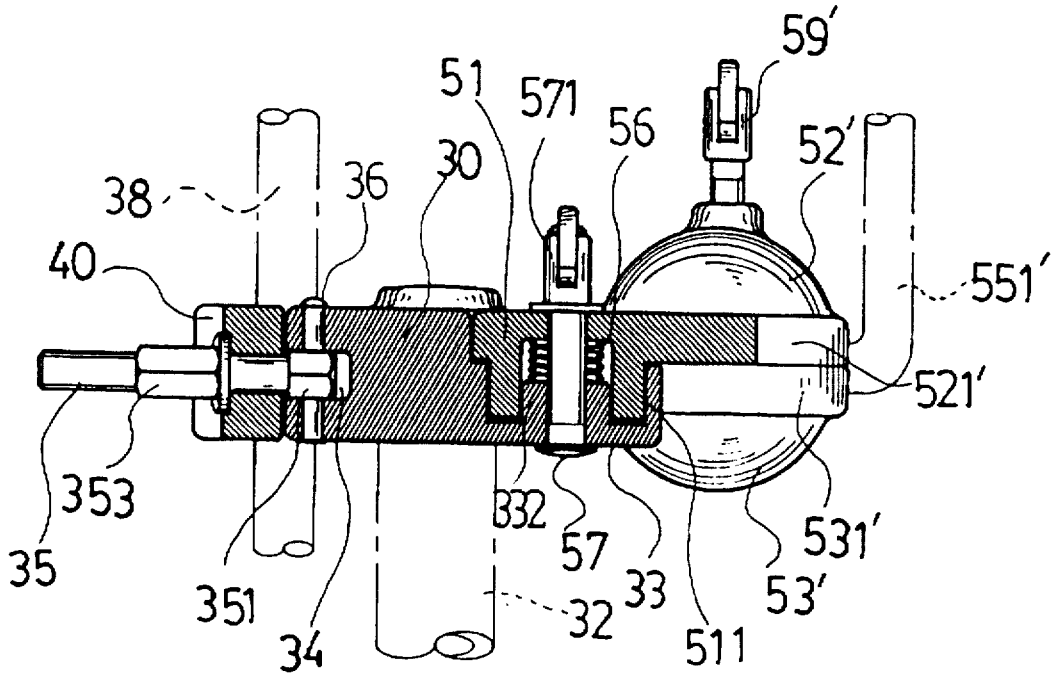
FIG. 8A is a sectional view taken along line A—A of FIG. 6B.
Figure 8B:
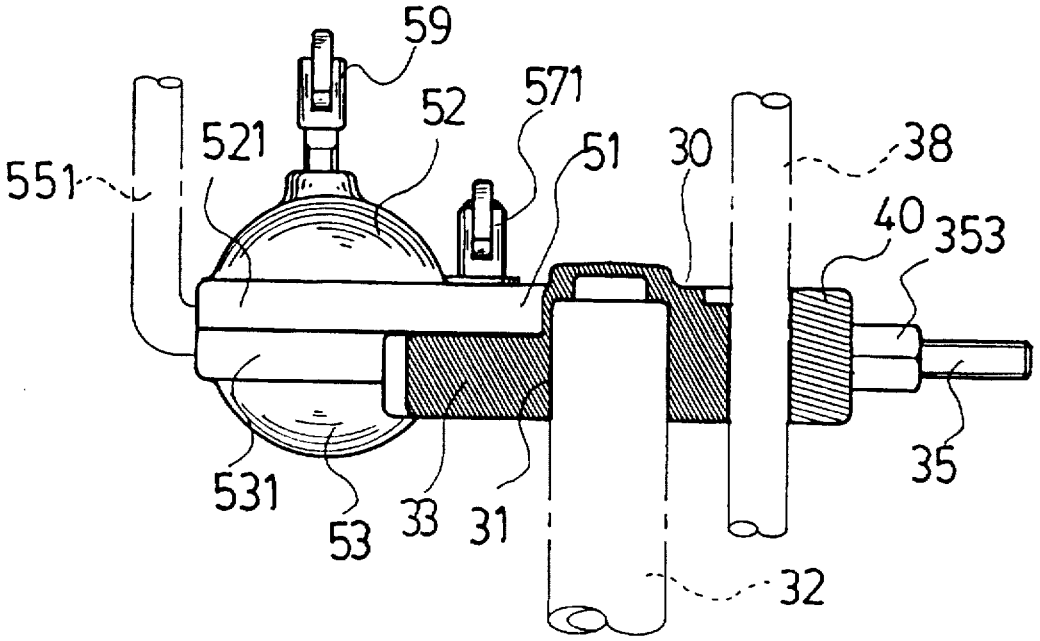
FIG. 8B is a sectional view taken along line B—B of FIG. 6B.
Figure 9:
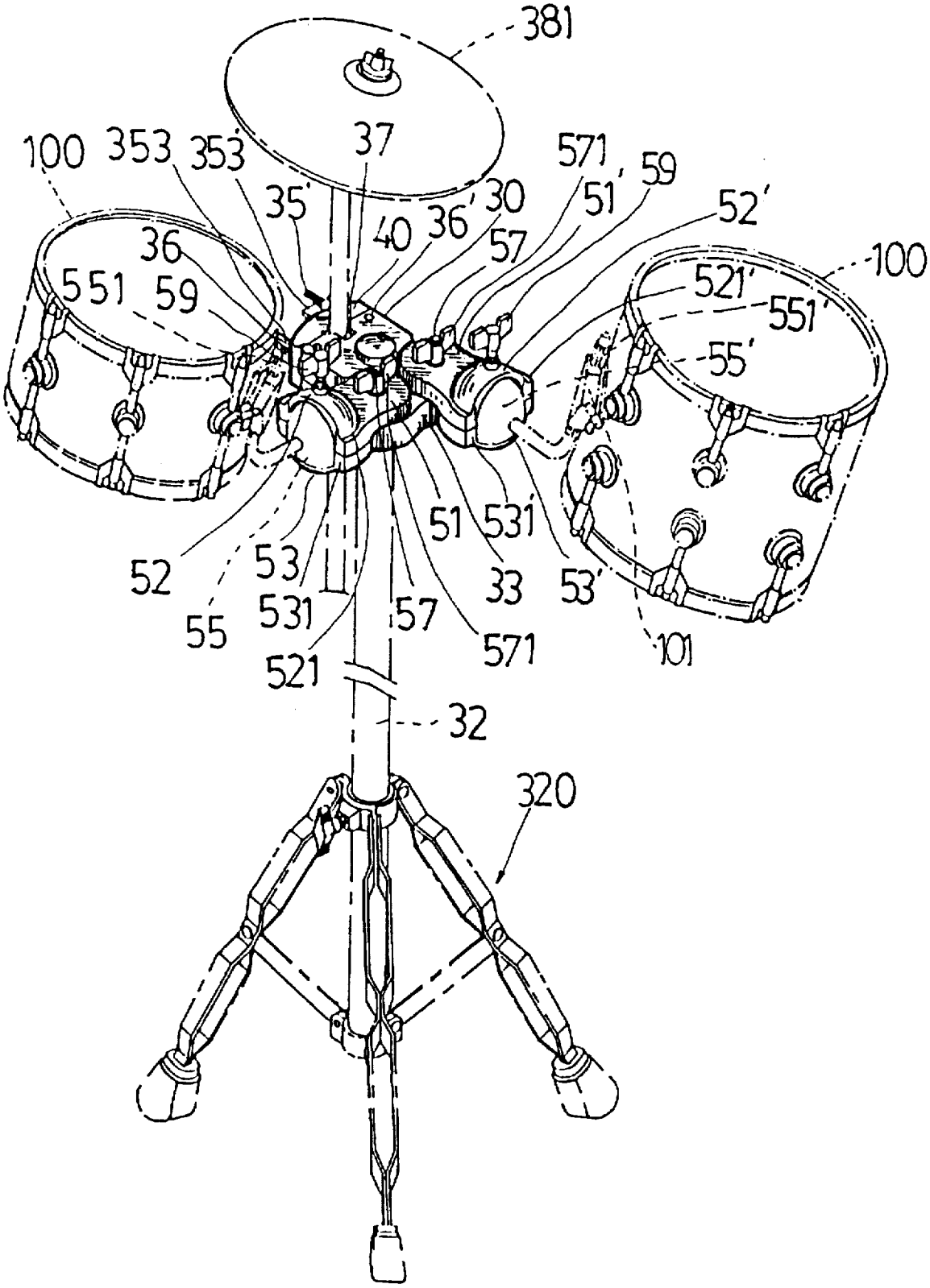
FIG. 9 is an applied view of the present invention, showing a stem mounted on the tom-tom holder at the top of an upright support of a drum stand, two drums carried on the L-shaped supporting rods, a cymbal carried on the stem.
Figure 10:
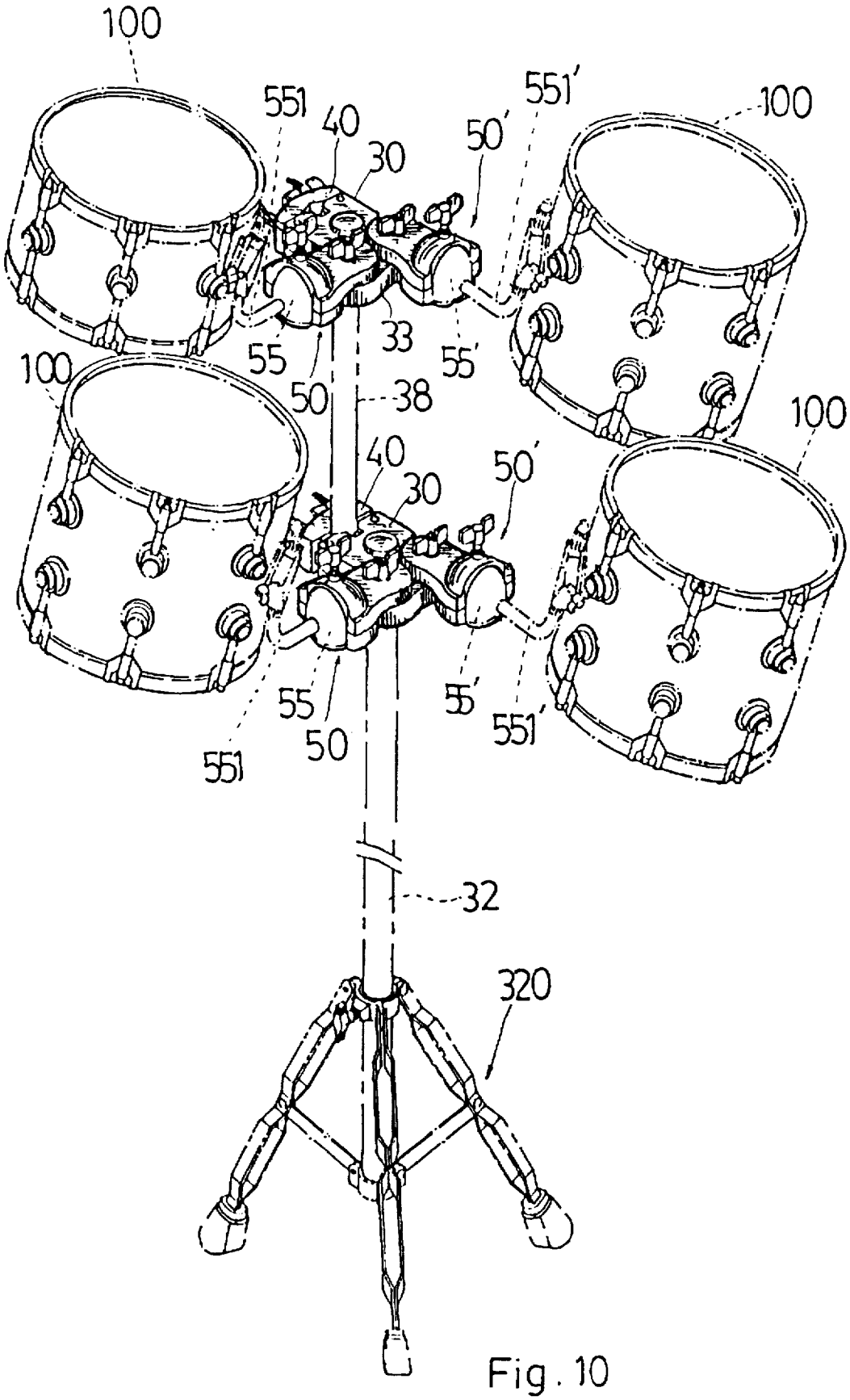
FIG. 10 is another applied view of the present invention, showing a first tom-tom holder mounted on an upright support of a drum stand, a stem mounted on the first tom-tom holder, a second tom-tom holder mounted on the stem, two pairs of drums respectively carried on the L-shaped supporting rods of the first and second tom-tom holders.

Referring to figures from 2 to 5 and FIGS. 8B, 9 and 10, a wide angle tom-tom holder in accordance with the present invention comprises a mounting base 30. The mounting base 30 comprises a recessed bottom coupling hole 31 at the center of its bottom side adapted for coupling to the top end of an upright support 32 of a drum stand 320 (see FIGS. 8B, 9 and 10), an extension block 33, two upward coupling chambers 331 331' defined within the extension block 33, two projecting blocks 332;332' respectively disposed in the upward coupling chambers 331;331', two mounting through hole 334;334' respectively made through the center of the projecting blocks 332;332', two horizontal openings 34;34' bilaterally disposed at an opposite side remote from the extension block 33, a notch 37 at one side between the horizontal openings 34;34', and two vertical through holes 341;341' made through its top and bottom sides and respectively inserting with the horizontal openings 34;34'. Two locating bolts 35;35' are respectively fastened to the mounting base 30 at one side, having a respective head 351;351' respectively mounted in the horizontal opening 34;34' of the mounting base 30, and a respective transverse through hole 352 or 352' made through the respective head 351;351' and respectively connected to the vertical through holes 341;341' of the mounting base 30 by a respective fastening element 36;36'. A clamping block 40 is secured to one side of the mounting base 30 to close its horizontal openings 34;34'. The clamping block 40 comprises a notch 41 at one side in the middle adapted to match with the notch 37 of the mounting base 30, and two mounting holes 42;42' bilaterally disposed in parallel and adapted to receive the locating bolts 35;35'. When the locating bolts 35;35' are respectively inserted through the mounting holes 42;42' of the clamping block 40, a screw nut 353 and a wind nut 353' are respectively threaded onto the locating bolts 35;35' to fix the clamping block 40 to the mounting base 30 and to hold a stem 38 in the notches 37;41 between the mounting base 30 and the clamping plate 40. At the top of the stem 38, a cymbal 381 (see FIG. 9) or a second tom-tom holder (see FIG. 10) may be mounted.

Referring to FIGS. 7, 8A, 9 and 10, two ball socket assemblies 50;50' are respectively mounted on the extension block 33 of the mounting base 30. The ball socket assembly 50 (50') comprises an upper shell 51 (51'), a hollow bottom shell 53 (53'), a ball 55 (55'), a L-shaped supporting rod 551

Figure 1:
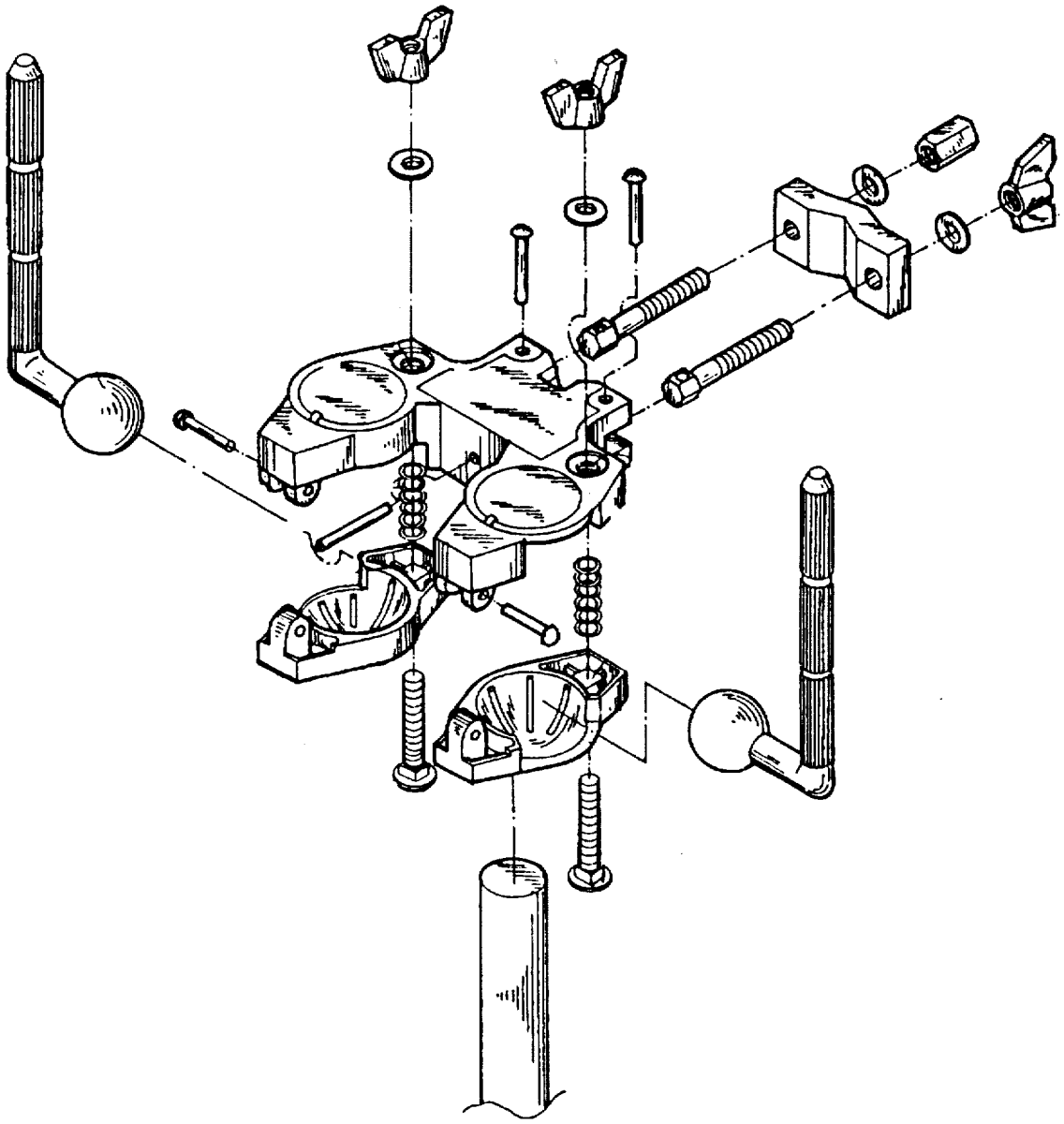
FIG. 1 is an exploded view of a tom-tom holder according to the prior art.
Figure 2:
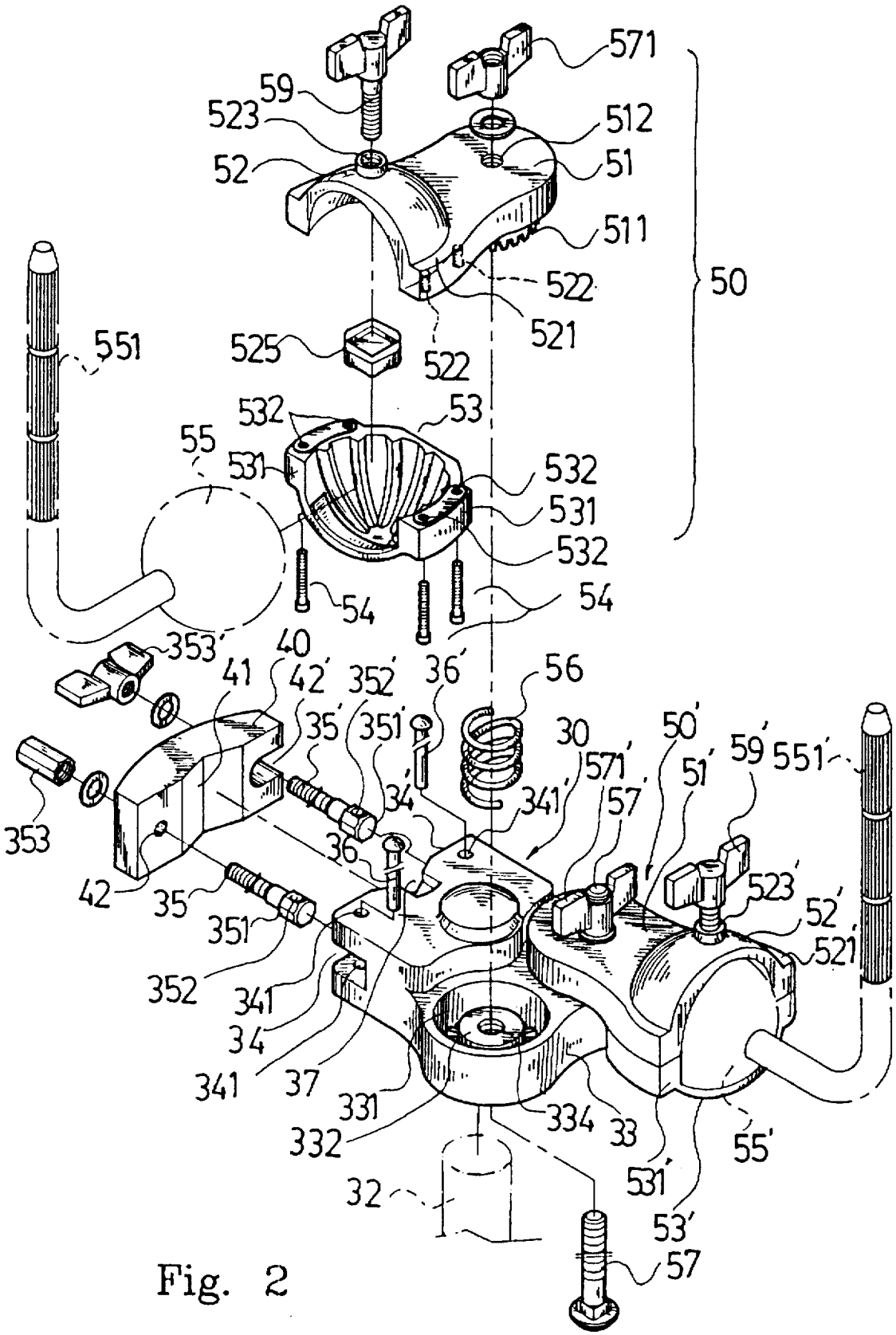
FIG. 2 is an exploded view of a tom-tom holder according to the present invention.
Figure 3:
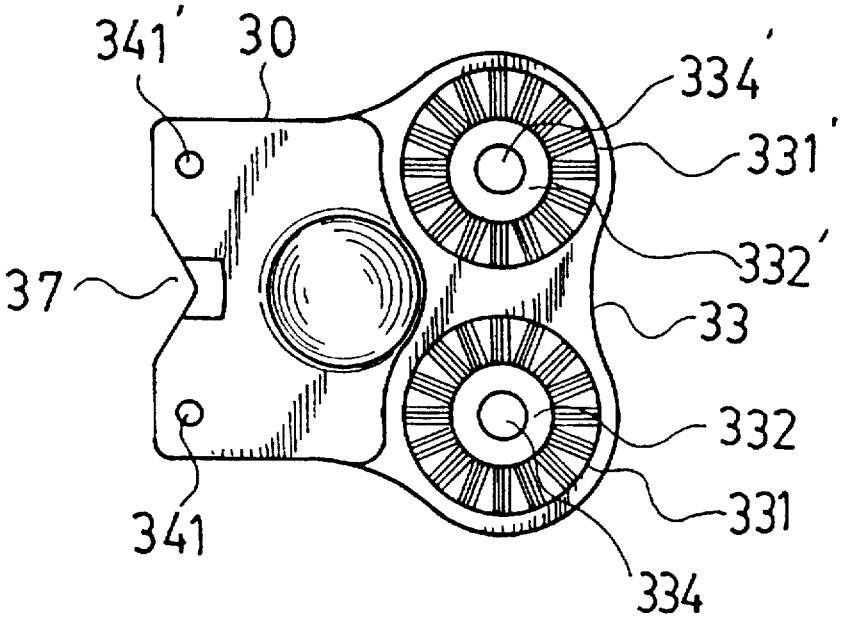
FIG. 3 is a top view in an enlarged scale of the mounting base according to the present invention.
Figure 4:
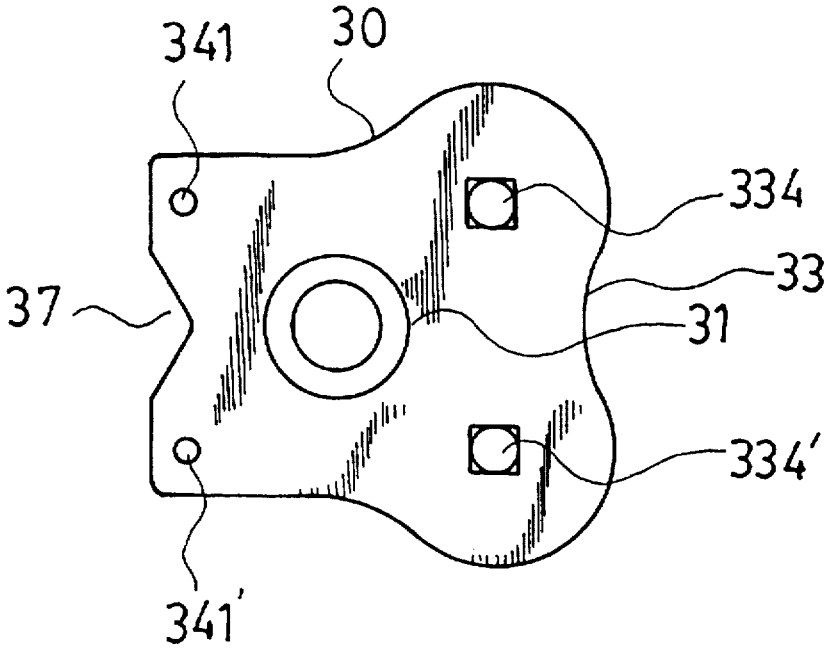
FIG. 4 is a bottom view in an enlarged scale of the mounting base according to the present invention.
Figure 5:
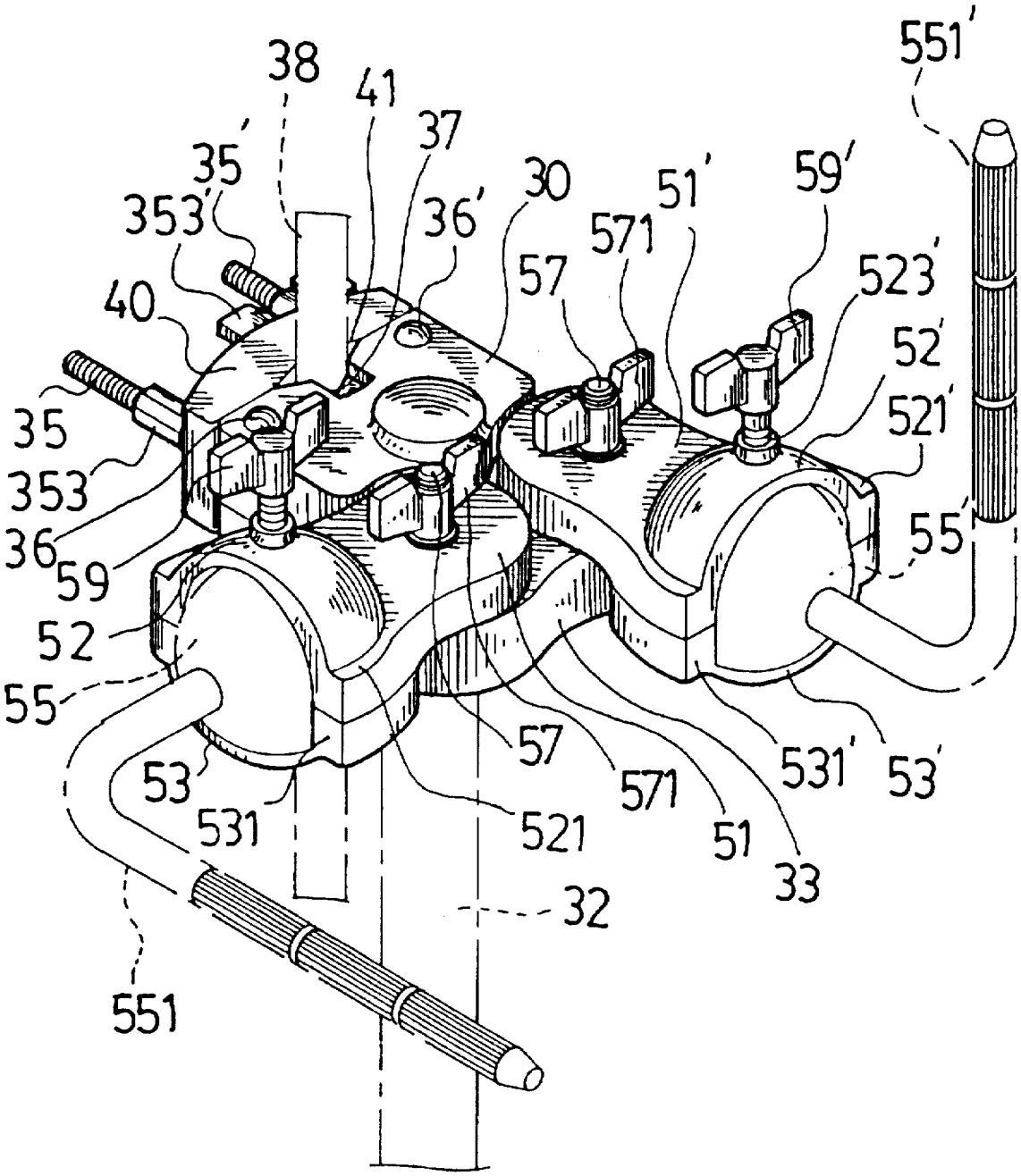
FIG. 5 is an elevational assembly view of the tom-tom holder according to the present invention.
Figure 6A:
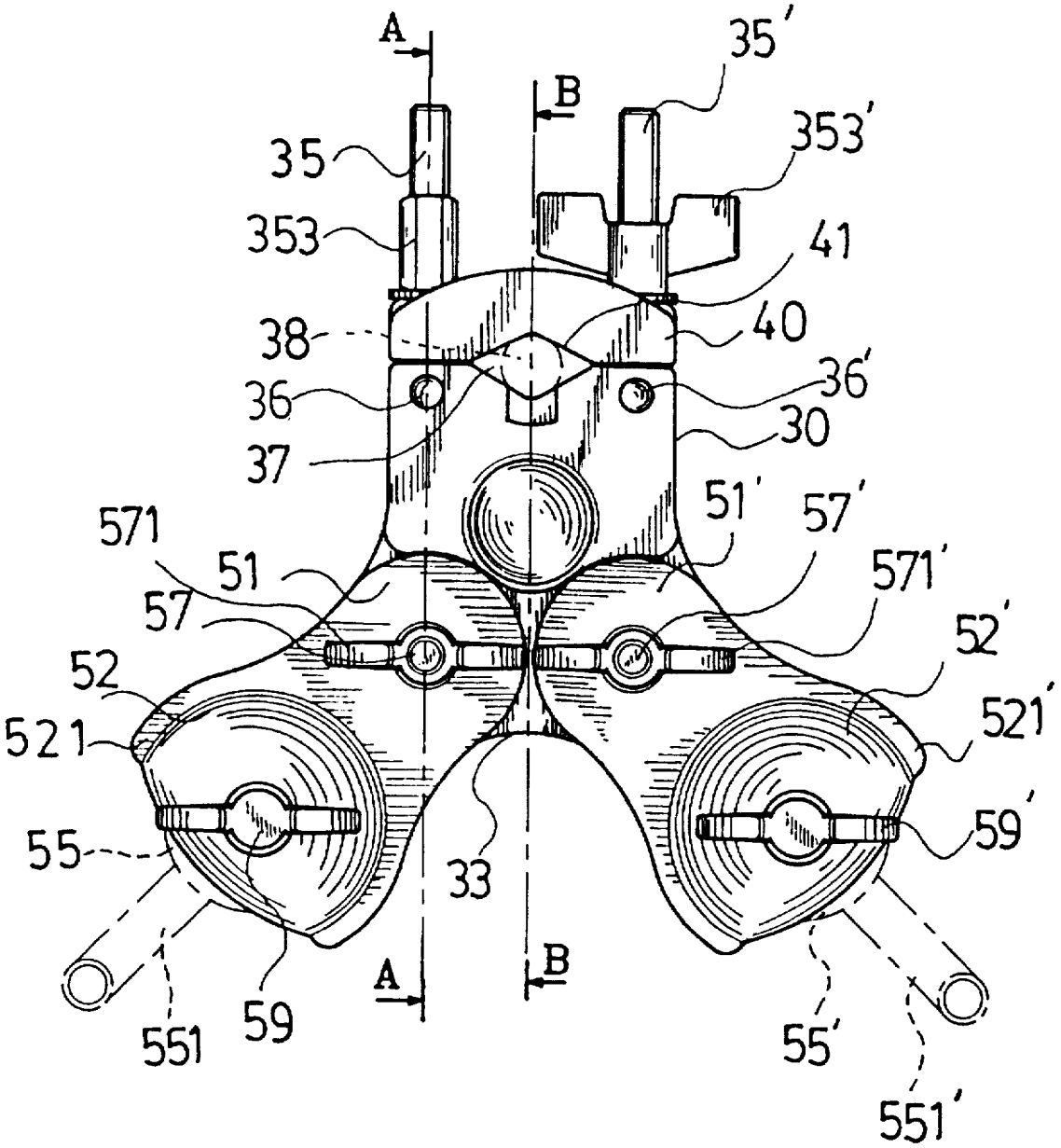
FIG. 6A is a top view of the tom-tom holder according to the present invention.
Figure 6B:
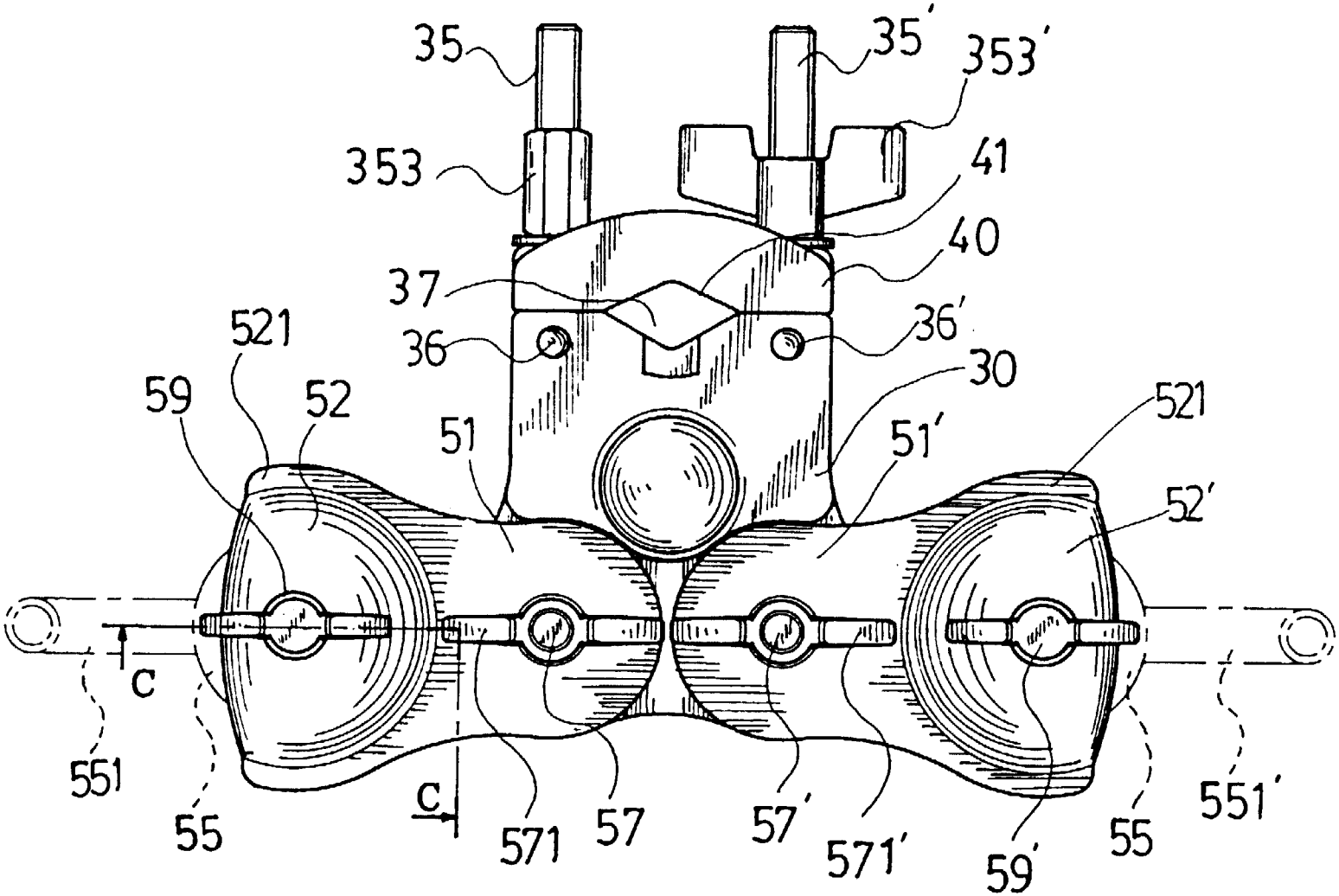
FIG. 6B is another top view of the present invention, showing the pitch between the ball socket assemblies adjusted.
Figure 7:
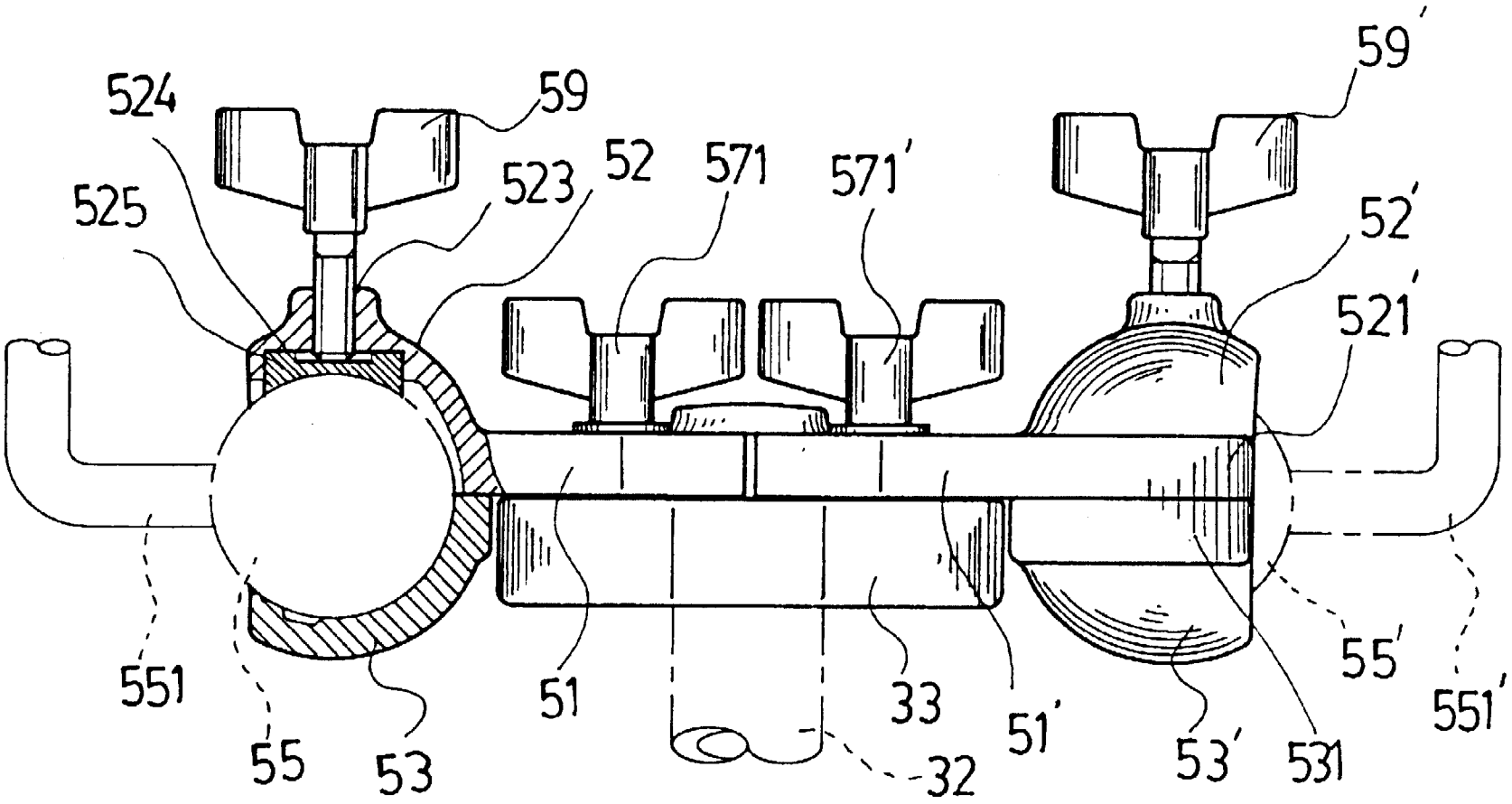
FIG. 7 is a sectional view taken along line C—C of FIG. 6B.

(551'), a pressure block 525 (525'), and a spring element 56 (56'). The upper shell 51 (51') comprises a first vertical through hole 512 (512') near one end, a tubular flange 511 (511') downwardly raised from its bottom side around the vertical through hole 512 (512'), a substantially hemispherical body portion 52 (52') at an opposite end, two flat coupling walls 521 (521') at two opposite sides of the hemispherical body portion 52 (52'), a plurality of downward mounting holes 522 (522') symmetrically disposed at the flat coupling walls 521 (521') an inside recess 524 (524') at the hemispherical body portion 52 (52') on the inside, and a second vertical through hole 523 (523') at the hemispherical body portion 52 (52') in communication with the inside recess 524 (524'). The bottom wall of the upward coupling chamber 331 (331') is preferably made with radial teeth, and the bottom side of the tubular flange 511 (511') is preferably made with radial teeth adapted for engagement with the radial teeth of the bottom wall of the upward coupling chamber 331 (331'). The hollow bottom shell 53 (53') comprises two flat coupling walls 531 (531') at two opposite sides, and a plurality of upward mounting holes 532 (532') symmetrically disposed at the flat coupling walls 531 (531'). The upward mounting holes 532 (532') of the hollow bottom shell 53 (53') are respectively fastened to the downward mounting holes 522 (522') of the upper shell 51 (51') by respective fastening elements 54 (54'). When the hollow bottom shell 53 (53') and the upper shell 51 (51') are fastened together, the hollow bottom shell 53 (53') and the hemispherical body portion 52 (52') of the upper shell 51 (51') are matched together and define a ball socket for holding the ball 55 (55') and an opposite end fastened to a connector 101 (101') at one side of a drum 100 (100') (see FIGS. 9 and 10). The L-shaped supporting rod 551 (551') has one end fixedly connected to the ball 55 (55'). The ball 55 (55') is turned in the ball socket defined between the hollow bottom shell 53 (53') and the hemispherical body portion 52 (52') of the upper shell 51 (51'). The pressure block 525 (525') is mounted within the inside recess 524 (524') of the upper shell 51 (51') and disposed in contact with the periphery of the ball 55 (55'). A holding-down screw 59 (59') is threaded into the second vertical through hole 523 (523') of the upper shell 51 (51'), and fastened up to impart a downward pressure to the pressure block 525 (525') against the ball 53 (53'), causing the ball 53 (53') to be firmly retained in position. The tubular flange 511 (511') of the upper shell 51 (51') is mounted in the upward coupling chamber 331 (331') of the mounting base 30 around the projecting block 332 (332'), then a screw bolt 57 (57') is inserted through the through hole 334 (334') of the projecting block 332 (332') and the first vertical through hole 512 (512') and screwed up with a wing nut 571 (571') to fix the ball socket assembly 50 (50') to the mounting base 30. The spring element 56 (56') is mounted around the screw bolt 57 (57') and retained between the projecting block 332 (332') and the upper shell Referring to FIGS. 5, 6A and 6B, when the holding-down screw 59 (59') is loosened, the ball 55 (55') can then be turned within the ball socket between the hemispherical body portion 52 (52') and the hollow bottom shell 53 (53') to adjust the angular position of the L-shaped supporting rod 551 (551'). When the wing nut 571 (571') is loosened, the ball socket assembly 50 (50') can then be turned about the screw bolt 57 (57') to change its angular position relative to the mounting base 30 (see FIGS. 6A and 6B).

While only one embodiment of the present invention has been shown and described, it will be understood that various modifications and changes could be made thereunto without departing from the spirit and scope of the invention disclosed.

I claim:

1. A wide angle tom-tom holder comprising a mounting base having a bottom coupling hole coupled to a top end of an upright support, two ball socket assemblies respectively fastened to said mounting base, two balls respectively turned in said ball socket assemblies, and two L-shaped supporting rods respectively connected to said balls and holding a respective drum, wherein:

said mounting base comprises an extension block at one side, two toothed upward coupling chambers respectively defined within said extension block, two projecting blocks respectively disposed in said toothed upward coupling chambers, two mounting through hole respectively made through the center of said projecting blocks;

each of said ball socket assemblies comprises an upper shell and a hollow bottom shell fixedly fastened together and defining a ball socket therebetween for holding one ball, said upper shell comprising a vertical through hole connected to one mounting through hole of said mounting base by a screw bolt and a nut, and a tubular flange downwardly raised from a bottom side thereof around said vertical through hole and mounted around one projecting block of said mounting base, said tubular flange having a bottom side toothed and forced into engagement with one of said toothed upward coupling chambers;

two spring elements are respectively mounted around said screw bolts and retained between said projecting blocks and the upper shells of said ball socket assemblies.

2. The wide angle tom-tom holder of claim 1, wherein said upper shell comprises a substantially hemispherical body portion at one end end, two flat coupling walls at two opposite sides of said hemispherical body portion, a plurality of downward mounting holes symmetrically disposed at the flat coupling walls of said hemispherical body portion, an inside recess at said hemispherical body portion on the inside, and a vertical screw hole at said hemispherical body portion in communication with said inside recess; said hollow bottom shell comprises two flat coupling walls at two opposite sides, and a plurality of upward mounting holes symmetrically disposed at the flat coupling walls of said hollow bottom shell and respectively fastened to the downward mounting holes of said upper shell by a respective fastening element; a pressure block is mounted in the inside recess of said upper shell and disposed in contact with the periphery of one ball; a holding-down screw is threaded into the vertical screw hole of said hemispherical body portion and stopped at said pressure block against the corresponding ball.

* * * * *